US005484225A

United States Patent [19]

Warner

[11] Patent Number: 5,484,225

[45] Date of Patent: Jan. 16, 1996

[54] TRAFFIC CHANNELIZING DEVICE

[75] Inventor: Randy L. Warner, Harrisburg, Pa.

[73] Assignee: Protection Services, Inc., Harrisburg, Pa.

[21] Appl. No.: 230,905

[22] Filed: Apr. 21, 1994

Related U.S. Application Data

[63] Continuation-in-part of Ser. No. 179,127, Jan. 10, 1994, abandoned.

[51] Int. Cl.[6] ..... E01F 9/04

[52] U.S. Cl. ..... 404/9; 404/12; 116/63 P; 116/63 C

[58] Field of Search ..... 404/6, 9, 10, 11, 404/12; 116/63 C, 63 P

[56] References Cited

U.S. PATENT DOCUMENTS

| | | | |
|---|---|---|---|
| 2,666,373 | 1/1954 | Mattson | 404/16 |
| 3,380,428 | 4/1968 | Abrams | 116/63 |
| 4,105,353 | 8/1978 | Bórk et al. | 404/2 |
| 4,245,922 | 1/1981 | Auriemma | 404/10 |
| 4,369,429 | 1/1983 | Souder | 340/119 |
| 4,372,536 | 2/1983 | Morse | 256/64 |
| 4,553,875 | 11/1985 | Casey | 404/6 |
| 4,645,168 | 2/1987 | Beard | 248/58 |
| 4,798,017 | 1/1989 | Giotis | 40/612 |
| 4,864,299 | 9/1989 | Kuhl | 340/908.1 |
| 4,958,954 | 9/1990 | Schmanski et al. | 404/10 |
| 5,036,791 | 8/1991 | Thurston | 116/63 C |
| 5,122,008 | 6/1992 | Drews | 404/6 |
| 5,123,773 | 6/1992 | Yodock | 404/6 |
| 5,165,818 | 11/1992 | Newhart | 404/10 |
| 5,168,827 | 12/1992 | Junker | 116/63 P |
| 5,286,136 | 2/1994 | Mandish et al. | 404/6 |
| 5,360,286 | 11/1994 | Russell | 404/6 |

*Primary Examiner*—Ramon S. Britts
*Assistant Examiner*—Pamela A. O'Connor
*Attorney, Agent, or Firm*—Popham, Haik, Schnobrich & Kaufman, Ltd.

[57] ABSTRACT

A two-part traffic channelizing device including a recycled rubber base (or other suitable material) having a slot with a textured interior surface extending therethrough and a vertically upwardly extending vertical member coated with reflective material and releasably inserted inside the slot, forming a friction/compression fit between the vertical member and the textured interior surface of the slot. The vertical member is held in position in the slot by friction/compression alone. Upon impact, the vertical member pops out of the slot, and the device is reassembled simply by reinserting the vertical member into the slot; no replacement parts are necessary, except for accessory items such as lighting devices or power sources.

27 Claims, 1 Drawing Sheet

TRAFFIC CHANNELIZING DEVICE

This is a Continuation-In-Part Application of U.S. patent application Ser. No. 08/179,127, filed Jan. 10, 1994, now abandoned, the entire contents of which are hereby incorporated by reference.

BACKGROUND OF THE INVENTION

1. Field of the Invention

The present invention relates to a traffic channelizing device. More specifically, the invention relates to a two-part channelizing device connected only by compression and friction.

2. Related Art

U.S. Pat. No. 5,165,818 to Newhart discloses a three-part channelizing device including a panel releasably connected to a base by a breakaway mounting assembly. When a predetermined force is applied to the panel, a pin inserted in the breakaway mounting assembly breaks, allowing the panel to fall to the ground. A new pin must be provided and inserted in the mounting assembly to reassemble the panel and base.

U.S. Pat. No. 5,168,827 to Junker shows a three-part traffic signalling device having a cone-like signaling body connected to a base element by a coupling member. The signaling body is made of a flexible material, so that if force is applied to the signaling body, it will bend without becoming disconnected from the base, and when the force is removed, the signalling body will return to an upright position.

U.S. Pat. No. 5,036,791 to Thurston discloses a stackable road delineator including a hollow cone-like element with a detachable weighted base. The road delineator is formed so that upon impact it can be tipped close to the ground and then return to its normal vertical position after impact, due to the weighted base.

U.S. Pat. No. 3,380,428 to Abrams shows a vertically extended rectangular traffic guide post that is held in place by being inserted into a slot in a water-weighted base member.

Known traffic signalling and channelizing devices either are formed to remain assembled upon impact, or, if formed as a breakaway device, require use of a mechanical mounting or locking assembly and replacement parts for reassembly after impact. Therefore, it is desirable to provide a two-part channelizing device that disassembles upon impact to allow a vehicle to pass safely over it, and that can be easily reassembled after impact without requiring replacement parts, or cumbersome mechanical connecting mechanisms.

SUMMARY OF THE INVENTION

The present invention provides a two-part traffic channelizing device. The inventive two-part traffic channelizing device overcomes the problems presented by prior art devices by providing a two-part device that disassembles upon impact so that a vehicle can pass safely over it, and that is easily reassembled without requiring any type of mechanical mounting or locking assembly or replacement parts.

The term "two-part" as used herein means that the inventive channelizing device is manufactured as two separate parts that are assembled and connected by friction and compression alone in a friction/compression fit, disassembles upon impact, and is easily reassembled without requiring any type of mechanical mounting or locking assembly or replacement parts.

The inventive two-part channelizing device includes a self-ballasting base containing a slot having a textured inner surface and a vertical member or panel releasably inserted in the slot and extending vertically upwardly from the base.

The base is preferably formed from recycled rubber or any other suitable material, has a rectangular configuration or any other suitable configuration, and has a sufficient weight so that it remains stationary when force, such as wind or vehicle impact, is applied to it. A slot located in the base has a textured inner surface and extends horizontally along the base's upper surface between its left and right sides and vertically into the base. Alternatively, the slot may extend at any angle across the base's upper surface. The orientation of the slot depends upon the configuration of the vertical member. The slot is configured to releasably receive at least one end of the vertical member and hold the vertical member in place by a friction/compression fit, without requiring an additional mechanical mounting or locking assembly.

Rods are embedded inside the base, at least one on each end of the slot between the end of the slot and the side of the base; to reinforce the section of the base between the ends of the slot and the sides of the base. These strengthening rods may or may not be used dependent upon the composition of the base material.

Preferably, the vertical member is formed from recycled plastic or any other suitable material and is coated with a reflective material or any other suitable coating material. At least one end of the vertical member is configured to releasably slide into the base slot. The vertical member may be rectangular, square, oval, or any other configuration suitable for engaging the textured surface of the slot in the base, which is shaped to receive the configuration of the vertical member.

The vertical member may also include a suitably shaped hole near its top edge to serve as a handle for carrying, assembling, and disassembling the device.

Alternatively, the hole is configured so that a lighting device can be attached to the vertical member through the hole to enhance visibility at night. The lighting device can be self-contained or connected to a power source, such as a battery which may be inserted in a depression in the base designed to receive such a power source. For example, the lighting device can be connected to a power source by a two conductor wire that may include a slip-together connector.

The vertical member or panel is held in place in the slot by a friction/compression fit between the vertical member and the textured slot surface in the base. Upon impact by a vehicle, the friction and compression bonds connecting the vertical member and base are released and the vertical member falls to the ground so that the vehicle can pass easily and safely over the device. When a wire connects the lighting device to a power source inserted in the base, the slip-together connector on the wire becomes disassembled as the vertical member falls to the ground so that the wire does not tear or break. The device is easily reassembled without requiring replacement parts or a mechanical mounting or locking assembly, by simply reinserting the vertical member into the base slot.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE PREFERRED EMBODIMENTS

Figure 1:
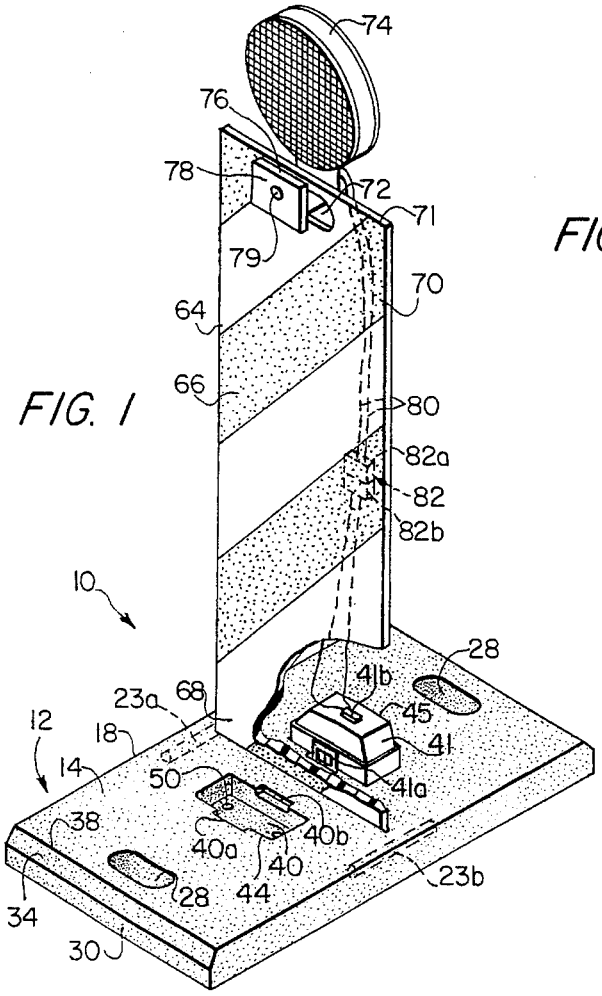
FIG. 1 illustrates a perspective view of the assembled channelizing device.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

The invention is described below with reference to the orientation of FIGS. 1 through 5.

Referring now to FIGS. 1–5, the inventive two-part traffic channelizing device 10 includes a self-ballasting base 12 having a top surface 14, a bottom surface 16, and a slot 22 located in the drawings at the center of base 12. Slot 22 extends horizontally between left and right sides 18, 20, of base 12 respectively, and vertically through base 12. Alternatively, slot 22 may extend diagonally, or at any angle across top surface 14 of base 22.

Figure 2:
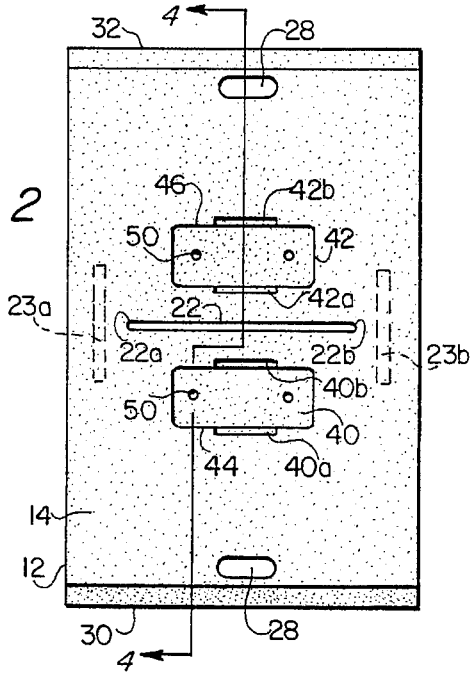
FIG. 2 illustrates a top view of the base.

As shown in FIGS. 1 and 2, base 12 is preferably rectangular, having a width of about 16" a length of about 26", and a depth of about 2.375". Alternatively, base 12 can be formed as a square, circle, oval, or any other shape or thickness.

Base 12 preferably has a sufficient weight so that it is self-ballasting and remains stationary when it is subjected to force, for example, wind or vehicle impact. The preferred weight of base 12 is about 32 pounds, although this can vary dependent on dimensions and materials.

Top surface 14 of base 12 preferably includes two oval-shaped holes 28 located at the front and rear ends 30, 32 of base 12, respectively. Holes 28 serve as handles for carrying the base. Preferably, holes 28 are about 1.5" wide and 4.0" long through their centers, although this can vary dependent on situations.

Front and rear ends 30, 32 of base 12, respectively, preferably include beveled top edges 34, 36, respectively, to allow a vehicle to easily and safely pass over base 12.

When lighting device 74 is not self-contained and requires an outside power source, preferably base 12 includes front and rear power source depressions 40, 42 located in front of and behind slot 22, respectively. Power source depressions 40, 42 are configured to receive any standard power source, such as a battery case 41 for supplying power to a light source 74, discussed in detail below. Power source depressions 40, 42 include front and rear notches, **40*a*, 40*b* and 42*a*, 42*b*, respectively for receiving battery case 41. Preferably, power source depressions 40, 42 are about 6⅞" long, 3" wide, and 1.5" deep. Outer edges 44, 46 of power source depressions 40, 42, respectively, are preferably positioned about 8.250" from top edges 38, 39 of beveled edges 34, 36**, respectively.

Battery case 41 is preferably rectangular, formed in upper and lower parts connected by connecting hardware **41*a*, such as a bolt, located along the side of battery case 41. Preferably, battery case 41 has a slightly tapered top 45 that will shed water and a hole 41*b* through top 45 configured to receive a wire 80, such as a two-conductor wire, that is connected to a battery cell mounted within the case 41. When battery case 41 is inserted in either front or rear power source depression 40 or 42, respectively, the case extends vertically upwardly and connecting hardware 41*a* fits into front and rear notches 40*a*, 40*b* or 42*a*, 42*b* of power source depression 40 or 42, respectively. Preferably, battery case 41 is about 6¾" long, 3" wide, and 5" high. Battery case 41 is connected to lighting device 74 by two-conductor wire 80 inserted into hole 41*b* of battery case 41. Wire 80 may include a releasable slip-together connector 82**, discussed in detail below.

Weep holes 50 are located within power source depressions 40, 42 and extend vertically through base 12 to allow water to drain from power source depressions 40, 42. Thus, weep holes 50 prevent water from accumulating in power source depressions 40, 42.

Figure 3:
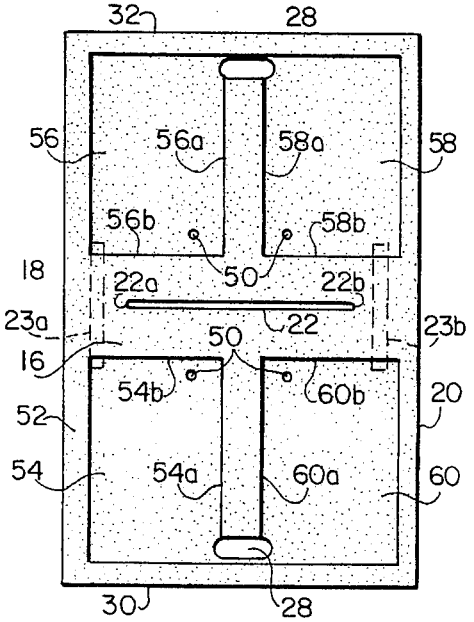
FIG. 3 illustrates a bottom view of the base.

Referring now to FIG. 3, preferably bottom surface 16 of base 12 includes an outer edge 52 extending around the periphery of base 12 and formed by four rectangular-shaped bottom depressions 54, 56, 58, and 60. Outer edge 52 is raised with respect to bottom depressions 54, 56, 58, and 60. This design allows outer edge 52 of bottom surface 16 to securely grip an uneven surface. Preferably, the distance between front end 30, left side 18, rear end 32, and right side 20 of base 12 and bottom depressions 54, 56, 58, and 60 is about 1.0" wide, and, accordingly, outer edge 52 is preferably about 1.0" wide. Bottom depressions 54, 56, 58, and 60 are preferably recessed about 0.375" from bottom surface 16 of base 12. Inner length edges **54*a*, 60*a* of bottom depressions 54, 56, respectively, are preferably 2.0" apart, as are inner length edges 56*a*, 58*a* of bottom depressions 56, 58, respectively, and inner width edges 54*b*, 56*b* of bottom depressions 54, 56, respectively, are preferably 4.0" apart, as are inner width edges 58*b*, 60*b* of bottom depressions 58, 60**, respectively.

Slot 22 is preferably located at the center of base 12 and extends transversely across the base 12, between left and right sides 18, 20, respectively, of base 12 and vertically through base 12. Alternatively, slot 22 may extend diagonally, or at any angle across base 12. Slot 22 is configured to releasably receive bottom portion 68 of vertical member 64 in a friction/compression fit, discussed in detail below. Preferably, slot 22 is about 12.250" long and 0.343" wide.

As shown in FIGS. 1 and 2, preferably rods **23*a*, 23*b* are embedded in base 12 between left side 18 of base 12 and left end 22*a* of slot 22, and between right side 20 of base 12 and right end 22*b* of slot 22, respectively. Rods 23*a*, 23*b* are provided to reinforce base 12 between its left side 18 and the left side 22*a* of slot 22 and its right side 20 and the right side 22*b* of slot 22, respectively, to prevent tearing of base 12. Rods 23*a*, 23*b* can be formed from any material having sufficient strength to reinforce base 12. Preferably, rods 23*a*, 23*b*** are formed from plastic, such as polyethylene, and have dimensions of either ⅜" diameter × 6" or ×½" diameter × 6".

Figure 5:
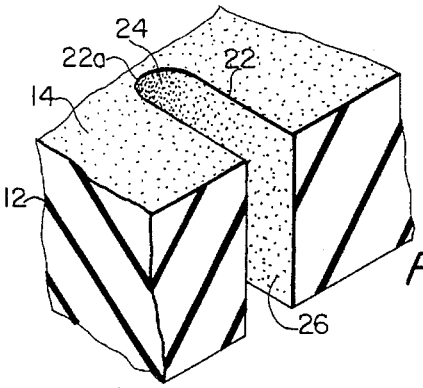
FIG. 5 illustrates a perspective cross-sectional view of the base slot.
Figure 4:
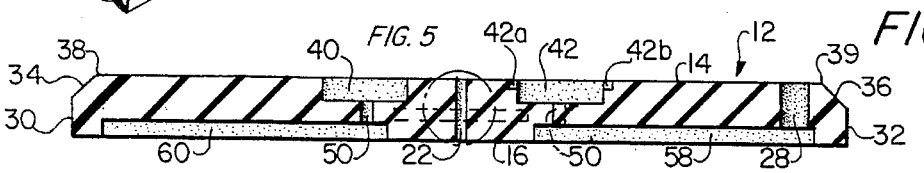
FIG. 4 is a view taken along lines 4—4 of FIG. 2.

Referring now to FIG. 5, slot 22 has a textured inner surface 24 to provide a friction/compression fit with bottom portion 68 of vertical member 64. Preferably, textured inner surface 24 includes a random granular rubble pattern 26.

Base 12 can be formed of any material capable of expanding and contracting to provide a friction/compression fit between inner surface 24 of slot 22 and bottom portion 68 of vertical member 64. Preferably, base 12 is formed of recycled rubber or recycled rubber buffings (fine powder shavings formed, for example, when a tire is ground prior to being retread). The recycled rubber may also include other recycled materials, such as recycled spandex or any other suitable material, virgin or recycled.

Referring now to FIG. 1, in a preferred embodiment vertical member or panel 64 is preferably rectangular and includes an outer surface 66, a bottom portion 68, and a top portion 70. Preferably, vertical member 64 is about 12" wide and 36" tall. Alternatively, vertical member 64 may be square, oval, or any other configuration suitable for engaging with textured inner surface 24 of slot 22 (conformed to accept the configuration of vertical member 64) and extending vertically upwardly from base 12.

Bottom portion 68 is configured to be releasably inserted into slot 22 in a friction/compression fit. Preferably, the thickness of bottom portion 68 ranges from about 0.350" to about 0.365" to provide sufficient friction and compression between bottom portion 68 and interior textured surface 24 of slot 22 to yield a friction/compression fit. Bottom portion 68 can be no thicker than the maximum preferred thickness or it will not fit inside slot 22 properly, and conversely bottom portion 68 can be no thinner than the minimum preferred thickness or there will be insufficient friction and compression between textured surface 24 of slot 22 and bottom portion 68 of vertical member 64 to releasably connect vertical member 64 and base 12 in a friction/compression fit. It is to be understood that, if the dimensions of slot 22 are altered, then the dimensions of bottom portion 68 of vertical member 64 may also be altered as necessary to provide a friction/compression fit between slot 22 and bottom portion 68.

Top portion 70 of vertical member 64 may also include a suitably shaped hole 72 near its top edge 71. Hole 72 can be used as a handle to carry vertical member 64, and/or hole 72 can be configured to receive a connecting fastener, such as a standard clamp 76, for connecting a lighting device 74 to vertical member 64. Preferably, hole 72 is about 4" long and 1" high through its center.

Vertical member 64 can be formed of any material that will not fracture on impact, for example, with a vehicle or the ground. Preferably, vertical member 64 is formed of recycled plastic. Outer surface 66 of vertical member 64 is preferably coated with a reflective coating to increase the visibility of vertical member 64, or any other suitable coating, for example, to increase the resistance of vertical member 64 to fracturing on impact. Standard reflective coatings are commercially available in various levels of reflectivity. One example of a reflective coating is a pressure-sensitive adhesive sheeting having a reflective pattern of angled orange and white stripes.

When device 10 is assembled, bottom portion 68 of vertical member 64 is inserted into slot 22 so that bottom portion 68 is in a friction/compression fit with inside textured surface 24 of slot 22. Vertical member 64 is held in place inside slot 22 by friction and compression between bottom portion 68 of vertical member 64 and textured surface 24 of slot 22; no additional mechanical mounting or locking mechanism is required.

Alternatively, a self-contained lighting device, such as a standard barricade light 74, can be attached to top portion 70 of vertical member 64 through hole 72. Any type of standard connecting means, such as a clamp 76, can be used to attach lighting device 74 to vertical member 64. Preferably, clamp 76 has first and second sides and a connecting fastener 79, and is used by placing lighting device 74 between the first side 78 and the second side (not shown) of clamp 76, and connecting the first and second sides using fastener 79, such as a screw, inserted through first side 78 of clamp 76, hole 72, and the second side (not shown) of clamp 76.

If the lighting device 74 is powered from an external source, it can be connected to battery case 41 by two-conductor wire 80. Wire 80 may include a releasable slip-together connector 82 having top and bottom ends **82*a*, 82*b* configured to releasably engage one another. Battery case 41 is inserted into base 12 in either front or rear power source depression 40 or 42, respectively, depending on whether the front or rear end 30, 32, respectively, of device 10** is facing traffic, as discussed below.

When assembled, lower portion 68 of vertical member 64 is releasably inserted into slot 22 so that it engages textured inside surface 24 of slot 22 and is held in place inside slot 22 by friction and compression in a friction/compression fit. Lighting device 74 is then attached to top portion 70 of vertical member 64 through hole 72.

When the power source for lighting device 74 is external, lighting device 74 is connected to battery case 41 inserted in either front or rear power source depression 40 or 42, respectively. Preferably, when device 10 is positioned so that front end 30 of base 12 is facing traffic, a power source is inserted into depression 42 behind vertical member 64, as shown in FIG. 1. Lighting device 74 would receive its power from battery case 41 by a two-conductor wire 80 having a releasable slip-together connector 82. On impact, top and bottom ends **82*a*, 82*b* of slip-together connector 82 separate, disconnecting light source 74 from battery case 41, so that wire 80 does not become shredded or torn when vertical member 64** falls to the ground or pavement surface.

If a moving vehicle hits device 10, friction and compression bonds holding vertical member 64 in slot 22 are released and vertical member 64 falls to the ground, allowing the vehicle to pass easily and safely over beveled top edge 34 of front end 30 and top surface 14 of base 12 and vertical member 64. To reassemble device 10, vertical member 64 is simply reinserted into slot 22 of base 12 to form a friction/compression fit; no additional mechanical mounting or locking assemblies or replacement parts are required. Then top and bottom ends **82*a*, 82*b* of slip-together connector 82 are reassembled to re-connect light source 74 to battery case 41**.

Modifications and variations of the above-described embodiments of the present invention are possible, as appreciated by those skilled in the art in light of the above teachings. For example, bottom depressions 54, 56, 58, and 60 can be formed in a shape other than rectangular, such as a square or a circle.

It is therefore to be understood that, within the scope of the appended claims and their equivalents, the invention may be practiced otherwise than as specifically described.

What is claimed is:

1. A two-part traffic channelizing device comprising:

a vertical member having a bottom portion; and a base having a slot, the slot being configured to receive the bottom portion of the vertical member, so that the bottom portion of the vertical member can be releasably inserted into the slot and held therein by compression and friction bonds alone, the compression and friction being sufficient to hold the bottom portion in the slot until a separating force is applied to the vertical member to release the compression and friction bonds and separate the vertical member from the base.

2. The channelizing device of claim 1, wherein the base is formed from a material capable of expanding and contracting to provide a compression fit between the bottom portion of the vertical member and the slot.

3. The channelizing device of claim 2, wherein the material comprises recycled rubber.

4. The channelizing device of claim 1, further comprising at least one hole extending through the base for drainage.

5. The channelizing device of claim 1, further comprising at least one depression positioned adjacent to the slot and configured to receive a power source, said power source inserted in the depression, and a lighting device attached to the vertical member and connected to the power source in the base, where applicable.

6. The channelizing device of claim 1, wherein the vertical member is formed from a fracture-resistant material.

7. The channelizing device of claim 6, wherein the material is recycled plastic.

8. The channelizing device of claim 1, wherein the vertical member is covered with a reflective coating.

9. The channelizing device of claim 8, wherein the reflective coating comprises a reflective sheeting.

10. The channelizing device of claim 1, wherein the base has a bottom containing a recessed inner portion and an outer edge that is raised with respect to the recessed inner portion, whereby the base is able to grip a surface.

11. The channelizing device of claim 1, wherein the base further comprises beveled edges, whereby a vehicle can pass over the base.

12. The channelizing device of claim 1, wherein rods are embedded in the base adjacent to each end of the slot, whereby the base is reinforced.

13. The channelizing device of claim 12, wherein the slot has first and second ends and a pair of longitudinally extending first and second rods are embedded in the base adjacent to the first and second ends of the slot, whereby the base is reinforced.

14. A two-part channelizing device comprising:

a vertical member having a bottom portion;

a base; and a slot extending through the base, the slot being configured to receive the bottom portion of the vertical member and having a textured inner surface for engaging the bottom portion of the vertical member, so that a friction/compression fit is provided between the portion of the vertical member and the textured inner surface of the slot, wherein the bottom portion of the vertical member can be releasably inserted into the slot and held therein by compression and friction bonds alone until a separating force is applied to the vertical member to release the compression and friction bonds and separate the vertical member from the base.

15. The channelizing device of claim 14, wherein the textured surface comprises a random granular rubble pattern.

16. The channelizing device of claim 14, wherein the base is formed from a material capable of expanding and contracting to provide a compression fit between the bottom portion of the vertical member and the slot.

17. The channelizing device of claim 14, wherein the material comprises recycled rubber.

18. The channelizing device of claim 14, further comprising at least one hole extending through the base for drainage.

19. The channelizing device of claim 14, further comprising at least one depression positioned adjacent to the slot and configured to receive a power source, said power source inserted in the depression, and a lighting device attached to the vertical member and connected to the power source in the base, where applicable.

20. The channelizing device of claim 14, wherein the vertical member is formed from a fracture-resistant material.

21. The channelizing device of claim 20, wherein the material comprises recycled plastic.

22. The channelizing device of claim 14, wherein the vertical member is coated with a reflective coating.

23. The channelizing device of claim 22, wherein said reflective coating comprises a reflective sheeting.

24. The channelizing device of claim 14, wherein the base has a bottom containing a recessed inner portion and an outer edge that is raised with respect to the recessed inner portion, whereby the base is able to grip a surface.

25. The channelizing device of claim 14, wherein the base further comprises beveled edges, whereby a vehicle can pass easily over the base.

26. The channelizing device of claim 14, wherein rods are embedded in the base adjacent each end of the slot, whereby the base is reinforced.

27. The channelizing device of claim 26, wherein the slot has first and second ends and a pair of longitudinally extending first and second rods are embedded in the base adjacent to the first and second ends of the slot, whereby the base in reinforced.

* * * * *